United States Patent [19]

Whitlock

[11] 3,952,997

[45] Apr. 27, 1976

[54] CARPET STRETCHING TOOL

[76] Inventor: Max D. Whitlock, Rte. 4, Mount Vernon, Ill. 62864

[22] Filed: Jan. 2, 1975

[21] Appl. No.: 537,918

[52] U.S. Cl. ..... 254/63

[51] Int. Cl.[2] ..... A47G 27/04

[58] Field of Search ..... 254/62, 63, 113; 294/8.6

[56] References Cited

UNITED STATES PATENTS

| | | | |
|---|---|---|---|
| 226,917 | 4/1880 | Fay | 254/63 |
| 231,666 | 8/1880 | Heintz | 254/63 |
| 501,617 | 7/1893 | Hankey | 254/63 |
| 515,995 | 3/1894 | Cooper | 254/63 |
| 681,257 | 8/1901 | Parrott | 254/63 |

*Primary Examiner*—Al Lawrence Smith
*Assistant Examiner*—Robert C. Watson
*Attorney, Agent, or Firm*—Gravely, Lieder & Woodruff

[57] ABSTRACT

Two standard pieces of lumber, called stretcher arms, are converted into a carpet stretching tool with a kit including a gripping head, a foot piece, and a pivot assembly. The gripping head is connected to one of the stretcher arms and has spikes which embed in a carpet. The foot piece is connected to the other arm and has a surface adapted to abut a wall adjacent the carpet. The pivot means includes a pair of clamps which tightly embrace the two stretcher arms and a bolt extended through clamps outwardly from the arms to enable the clamps and arms to pivot relative to each other. When a downwardly directed force is applied to the arms at the pivot assembly to cause the included angle between the arms to increase, the gripping head moves away from the foot piece and stretches the carpet.

9 Claims, 6 Drawing Figures

CARPET STRETCHING TOOL

BACKGROUND OF THE INVENTION

This invention relates in general to carpet laying and more particularly to a carpet stretching tool.

It is quite common for home owners and apartment dwellers to attempt to lay their own carpeting and thereby save much of the cost of installing carpeting. However, without the correct tools, the task is undertaken with great difficulty and at the risk of having ill-fitted and rippled carpeting. One of the most important tools used by professional carpet installers is a carpet stretcher. This tool bridges the room and has a gripping head at one end which bites into the carpeting. A manually applied force causes the tool to extend in length and thereby move the gripping head away from the opposite end of the tool. In so doing, it stretches the carpet so that the carpet lays perfectly flat and without ripples.

Carpet stretchers of current manufacturer are designed for use over and over again by professional carpet layers and hence are quite expensive. Indeed, the cost of such tools often exceeds the labor cost for laying the carpet. Moreover, they are of extended length and hence are not easily transported in automobiles.

SUMMARY OF THE INVENTION

One of the principal objects of the present invention is to provide a carpet laying tool which can be sold for modest cost for use by home owners and apartment dwellers who wish to install their own carpeting. Another object is to provide a carpet laying tool of the type stated in which major components are supplied in kit form. A further object is to provide a carpet laying tool of the type stated which can be easily and quickly assembled by the user. An additional object is to provide a carpet laying tool of the type stated in which the components sold in kit form are united with common pieces of lumber to form the complete tool. These and other objects and advantages will become apparent hereinafter.

The present invention is embodied in a gripping head, a foot piece and a pivot means all of which are united with a pair of stretcher arms to form a carpet stretching tool. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figure 1:
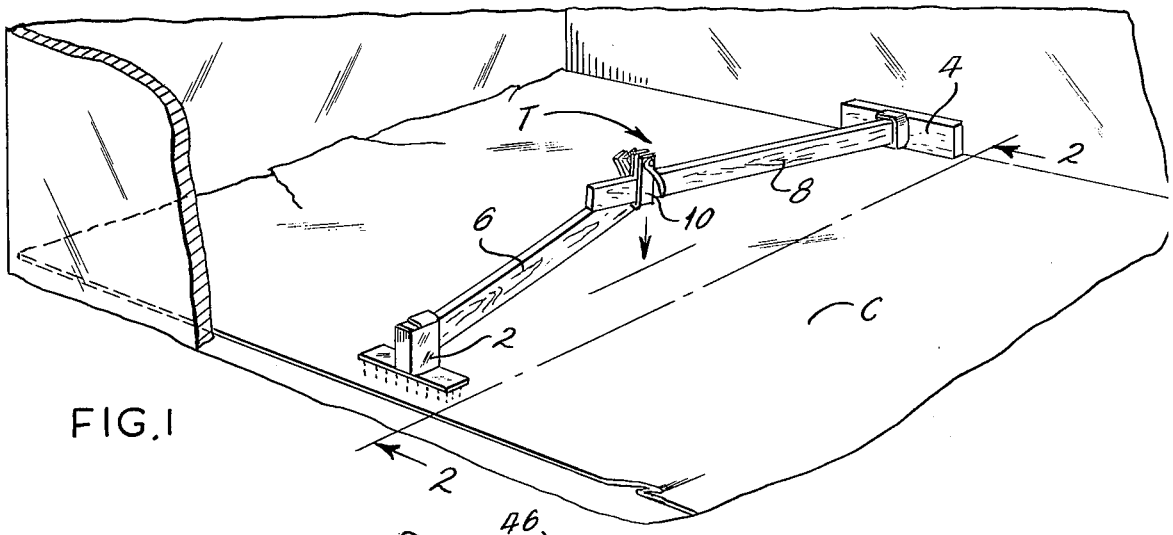
FIG. 1 is a perspective view showing the carpet stretching tool of the present invention extended across the room for stretching a carpet in the room.
Figure 2:
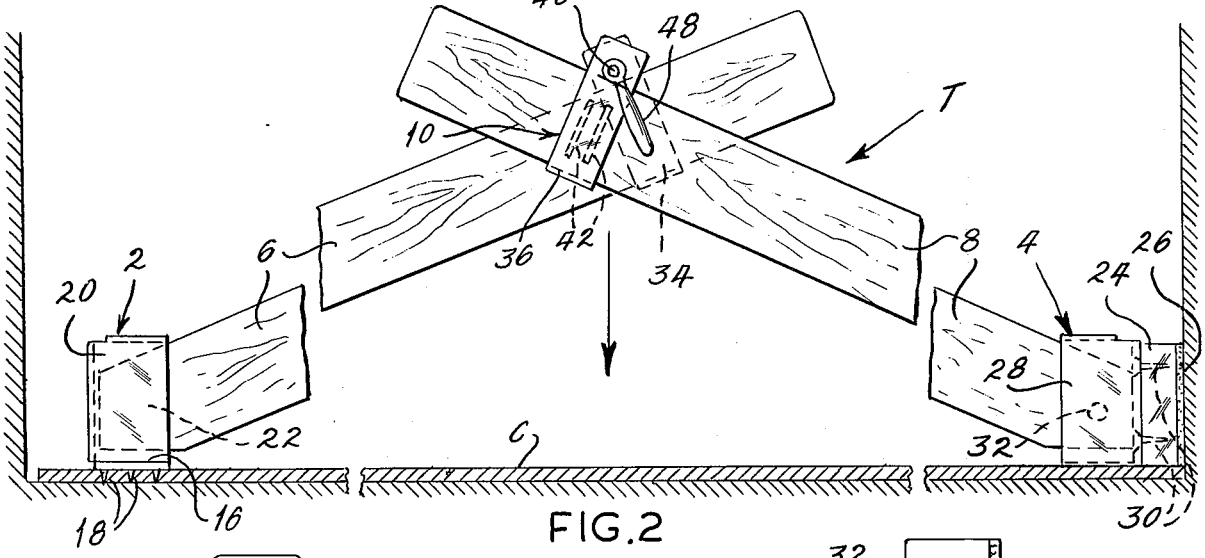
FIG. 2 is a fragmentary elevational view of the carpet stretching tool.
Figure 3:
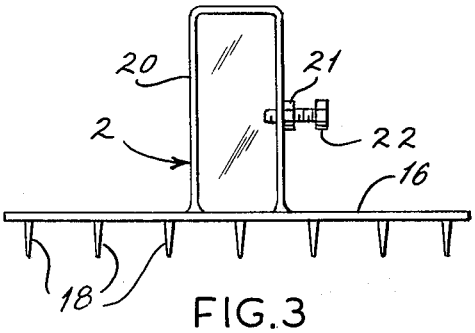
FIG. 3 is an end elevational view of the gripping head for the tool.
Figure 5:
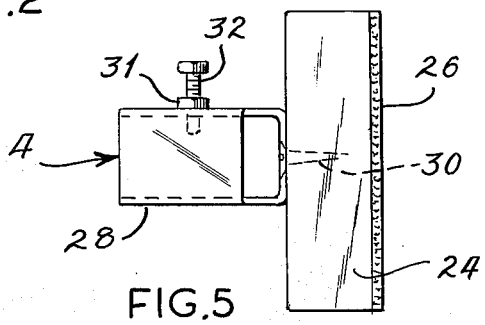
FIG. 5 is a top plan view of the foot piece for the stretching tool.
Figure 4:
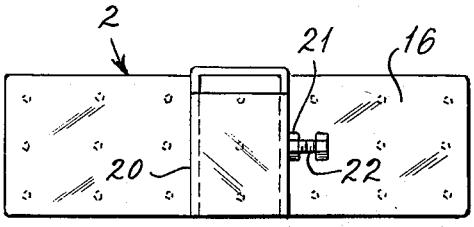
FIG. 4 is a top plan view of the gripping head.
Figure 6:
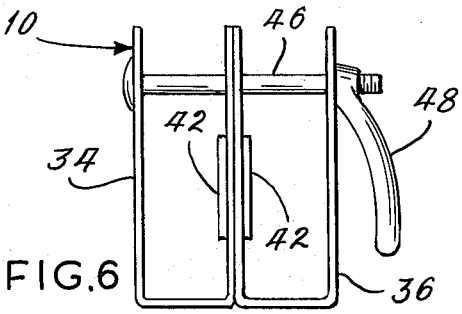
FIG. 6 is an end elevational view of the pivot assembly for the stretching tool.

Referring now to the drawings, a tool T for laying a carpet C includes several basic components, namely, a gripping head 2, a foot piece 4, a pair of extended stretcher arms 6 and 8, one of which is connected to the head 2 and the other to the foot piece 4, and a pivot assembly 10 pivotally connecting the stretcher arms 6 and 8 between the head 2 and the block 4.

The stretcher arms 6 and 8 may be merely pieces of lumber of conventional size and shape such as 2 inches by 2 inches or 2 inches by 4 inches The end of each stretcher arm 7 and 8 is cut to a V-shaped configuration with the apex of the V being slightly off center.

The gripping head 2 includes a relatively heavy plate 16 having spikes 18 secured firmly therein and projecting from one face thereof. The spikes 18 are about 5/8 inch long and are mounted with their axes parallel and perpendicular to the face of the plate 16. Welded to the opposite side of the plate 16 is a bracket 20 which forms a rearwardly opening socket on the gripping head 2. The two side walls of the bracket 20 are parallel with the spacing between them being slightly greater than the thickness of the stretcher arm 6 which is preferably a 2 inches by 4 inches The front wall bracket 20 constitutes a bearing wall against which the apex of the V-shaped end on the stretcher arm 6 bears. One of the two side walls of the bracket 20 has a nut 21 welded to it and threaded into this nut is a bolt 22 which when tightened will project into the socket-like interior of the bracket 20 and bear against the side of the stretcher arm 6, thus securing the gripping head 2 to the arm 6. The connection is such that the head 2 may pivot relative to the arm 6.

The foot piece 4 includes a wall block 24 having a soft material 26, such as a fabric material or carpet remnant, extended over one face thereof. Secured against the other face of the wall block 24 is a bracket 28 which forms a socket and is quite similar to the bracket 20 on the gripping head 2. The back wall of the bracket 28 abuts against the opposite face of the wall block 23 and is secured thereto by wood screws 30. The side walls of the bracket 28 project beyond the face of the block 24 and are spaced apart a distance slightly greater than the thickness of the stretcher arm 8. One of the two side walls has a nut 31 welded to it and extended through the nut 31 is a bolt 32. The V-shaped end of the stretcher arm 8 fits into the socket formed by the brackets 28 with the apex of the V abutting against the back wall of the bracket 28. The bolt 32, when tightened, projects into the interior of the bracket 28 and bears against the arm 8 to secure the foot piece 4 to the arm 8. The connection is such that the foot piece 4 may pivot relative to the arm 8.

The pivot assembly 10 includes a pair of U-shaped clamps 34 and 36, each of which has a bright portion 38 and a pair of parallel legs 40 extended therefrom. The length of each bight portion 38 equals the thickness of the beam 6 or 8, while the length of the legs 40 is somewhat greater than the width of the arm 6 or 8. One leg 40 has a pair of ribs 42 which project inwardly toward the opposite leg 40. Near their outer or free ends, the legs 40 are provided with apertures 44 through which a common bolt 46 extends. The bolt 46 permits the clamps 34 and 36 to pivot relative to each other. Threaded over the bolt is a wing nut 48 which when tightened forces the legs 40 of the clamps 34 and 36 together.

The gripping head 2, foot piece 4, and pivot assembly 6 may be sold in kit form, whereas the stretcher arms 6 and 8 are essentially common 2 inch × 4 inch lumber and may be purchased at any lumber yard. Of course, the lumber which is purchased will most likely have to be trimmed to the desired length and cut at its ends to provide the V-shaped surfaces.

OPERATION

To assemble the carpet stretching tool T, the stretcher arms 6 and 8 are first trimmed to provide the V-shaped ends as previously indicated. The V-shaped end of the arm 6 is then fitted into the socket of the brackets 20 for the gripping head 2, and the bolt 22 is tightened down against it, thus securing the gripping head 2 to the arm 6. Similarily, the V-shaped end of the arm 8 is fitted into the socket of the bracket 28 for the foot piece 4 and the bolt 32 is tightened down against it, thus securing foot piece 4 to the arm 8.

Once the gripping head 2 and the foot piece 4 are installed on the stretcher arms 6 and 8, respectively, the clamp 34 is fitted over the arm 6 and likewise the clamp 36 is fitted over the arm 8. This may be done with or without the bolt 46 in place, but it is usually easier with the bolt 46 removed. In any event, once the clamps 34 and 36 are installed and the bolt 46 is extended through them, the clamps 34 and 36 are moved longitudinally along their arms 6 and 8 until the length of the tool T is slightly greater than the distance between the location on the carpet where the stretching force is to be applied and a wall surface on the opposite side of the room. The correct length may be easily obtained by placing the wall block 24 of the foot piece 4 against the wall and forcing the spikes 18 of the gripping head into the carpet C, at the location where the stretching force is to be applied to the carpet C. The clamps 34 and 36 are then moved longitudinally along the arms 6 and 8 until their bottom surfaces or bight portions 38 are located about 6 to 12 inches above the carpet C. Of course, when the clamps 34 and 36 are so disposed, the distance from the clamp 34 to the gripping head 2 should about equal the distance between the clamp 36 and the foot piece. In other words, the pivot assembly 10 should be located midway between the gripping head 2 and foot piece 4.

After the pivot assembly 10 is located to provide the tool T with the correct length, the wing nut 48 is tightened over the bolt 46. This urges the legs 40 of the clamps 34 and 36 together and causes the ribs 42 to embed in the side faces of the arms 6 and 8, thus positioning the clamps 34 and 36 firmly on their respective arms 6 and 8.

Next, the user forces the arms 6 and 8 downwardly at the pivot assembly 10 so the downwardly presented included angle between the arms 6 and 8 increases. This, of course, drives the gripping head 2 away from the foot piece 4. Since the gripping head 2 bites into the carpet C with its spikes 18, the portion of the carpet C engaged by the head 2 also moves, thereby stretching the carpet C and causing it to lay smoothly.

This invention is intended to cover all changes and modifications of the example of the invention herein chosen for purposes of the disclosure which do not constitute departures from the spirit and scope of the invention.

What is claimed is:

1. A carpet stretching tool comprising: a gripping head having spikes positioned thereon to embed in a carpet, the gripping head further having spaced apart parallel walls which form a bracket thereon; a foot piece having a generally flat surface adapted to abut against a fixed surface and having its end between the parallel walls of the bracket on the gripping head; a first bolt extended through one of the walls of the bracket on the gripping head and bearing against first stretcher arm to secure the first stretcher arm to the bracket of the gripping head; a second stretcher arm pivotally connected to the foot peice and having its end between the walls of the bracket on the foot piece; a second bolt extended through one of the walls of the bracket on the foot piece and bearing against the second stretcher arm to secure the second stretcher arm to the bracket of the foot piece; and pivot means pivotally connecting the stretcher arms to enable the arms to pivot relative to each other to vary the angle between them, the pivot means being capable of firmly engaging the stretcher arms so as to not slide longitudinally along the arms, whereby when the included angle between the arms increases, the gripping head will move away from the foot piece and stretch the carpet.

2. A carpet stretching tool according to claim 1 wherein the pivot means positions the stretcher arms side-by-side and the pivot axis of the pivot means is located outwardly from the arms.

3. A carpet stretching tool comprising: a gripping head having spikes positioned thereon to embed in a carpet; a foot piece adapted to bear against a fixed surface; a first stretcher arm pivotally connected to the gripping head; a second stretcher arm connected to the foot piece; and pivot means pivotally connecting the stretcher arms to enable the arms to pivot relative to each other to vary the angle between them, the pivot means being capable of firmly engaging the stretcher arms so as to not slide longitudinally along the arms, whereby when the included angle between the arms increases the gripping head will move away from the foot piece and stretch the carpet, said pivot means comprising a first U-shaped clamp embracing the first arm, a second U-shaped clamp embracing the second arm, and a bolt extended through the clamps outwardly from the arms.

4. A carpet stretching tool according to claim 3 wherein each clamp includes a pair of legs and a bight portion, and the bolt extends through the legs and urges them together when tightened, whereby the stretcher arms are clamped securely between the legs.

5. A carpet stretching tool according to claim 4 wherein the inside faces of the legs on the clamps are provided with means which embed in the arms and prevent the clamps from moving longitudinally along the arms.

6. A kit for converting a pair of beams into a carpet stretching tool, said kit comprising: a gripping head having spikes capable of engaging and biting into a carpet, the head further including means for pivotally connecting it to one of the beams; a foot piece having a surface adapted to abut against a wall, the foot piece further including means for pivotally connecting it to the other beam; and pivot means for pivotally connecting the beams and including a first clamp embracing said one beam, a second clamp embracing said other beam, and means pivotally connecting the clamps outwardly from the beams so that when the included angle between the beams enlarges, the gripping head moves away from the wall block and stretches the carpet.

7. A kit according to claim 6 wherein each clamps includes a pair of legs and a bight portion connecting the legs; and wherein the means pivotally connecting the beams is a bolt extended through the legs of the clamp.

8. A kit according to claim 7 wherein the legs on their inside faces are provided with gripping means which bite into the beams and prevent the clamps from moving longitudinally along the beams.

9. A kit according to claim 8 wherein the gripping means comprises ribs on the legs.

* * * * *